US008451198B2

(12) United States Patent
Matsuoka et al.

(10) Patent No.: US 8,451,198 B2
(45) Date of Patent: May 28, 2013

(54) DISPLAY DEVICE AND ELECTRIC APPARATUS USING THE SAME

(75) Inventors: Toshiki Matsuoka, Osaka (JP); Tomoko Teranishi, Osaka (JP); Kazuhiro Deguchi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 365 days.

(21) Appl. No.: 12/996,937

(22) PCT Filed: Apr. 30, 2009

(86) PCT No.: PCT/JP2009/058469

§ 371 (c)(1),
(2), (4) Date: Dec. 8, 2010

(87) PCT Pub. No.: WO2010/016304

PCT Pub. Date: Nov. 2, 2010

(65) Prior Publication Data

US 2011/0080439 A1 Apr. 7, 2011

(30) Foreign Application Priority Data

Aug. 5, 2008 (JP) ..... 2008-202180

(51) Int. Cl.
*G09G 3/34* (2006.01)

(52) U.S. Cl.
USPC ..... 345/84; 345/107; 345/204

(58) Field of Classification Search
USPC ..... 345/84, 107, 204, 690; 359/296
See application file for complete search history.

(56) References Cited

U.S. PATENT DOCUMENTS

| | | | | |
|---|---|---|---|---|
| 7,843,545 | B2 * | 11/2010 | Jung et al. | |
| 8,259,038 | B2 * | 9/2012 | Matsuoka et al. | |
| 2004/0196525 | A1 | 10/2004 | Fujii et al. | |
| 2006/0077330 | A1 | 4/2006 | Ijzerman et al. | |
| 2007/0075941 | A1 | 4/2007 | Zhou et al. | |
| 2009/0059348 | A1 * | 3/2009 | Niwano et al. | 359/296 |

FOREIGN PATENT DOCUMENTS

| | | |
|---|---|---|
| JP | 2009-003017 | 1/2009 |
| WO | 2007/007879 | 1/2007 |
| WO | 2008/155925 | 12/2008 |
| WO | 2008/155926 | 12/2008 |

OTHER PUBLICATIONS

International Search Report for PCT/JP2009/058469, mailed Aug. 18, 2009.

* cited by examiner

*Primary Examiner* — Regina Liang
(74) *Attorney, Agent, or Firm* — Nixon & Vanderhye, P.C.

(57) ABSTRACT

A display device (10) includes an upper substrate (first substrate) (2), a lower substrate (second substrate) (3), and a conductive liquid (16) that is sealed in a display space (S) formed between the upper substrate (2) and the lower substrate (3) so as to be moved toward an effective display region (P1) or a non-effective display region (P2). The display device (10) includes a signal electrode (4), a reference electrode (5), and a scanning electrode (6). An M voltage (intermediate voltage) between an H voltage (first voltage) and a L voltage (second voltage) and a voltage other than the M voltage are applied to the signal electrode (4) within a selected period (predetermined period) T during which one of the H voltage and the L voltage is applied to the reference electrode (5).

10 Claims, 10 Drawing Sheets

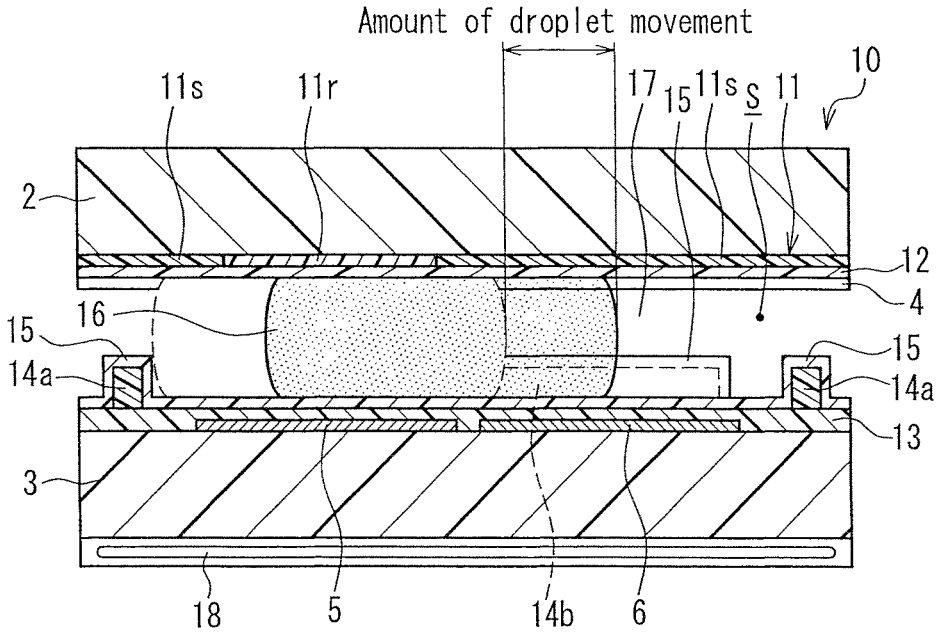
FIG. 7A
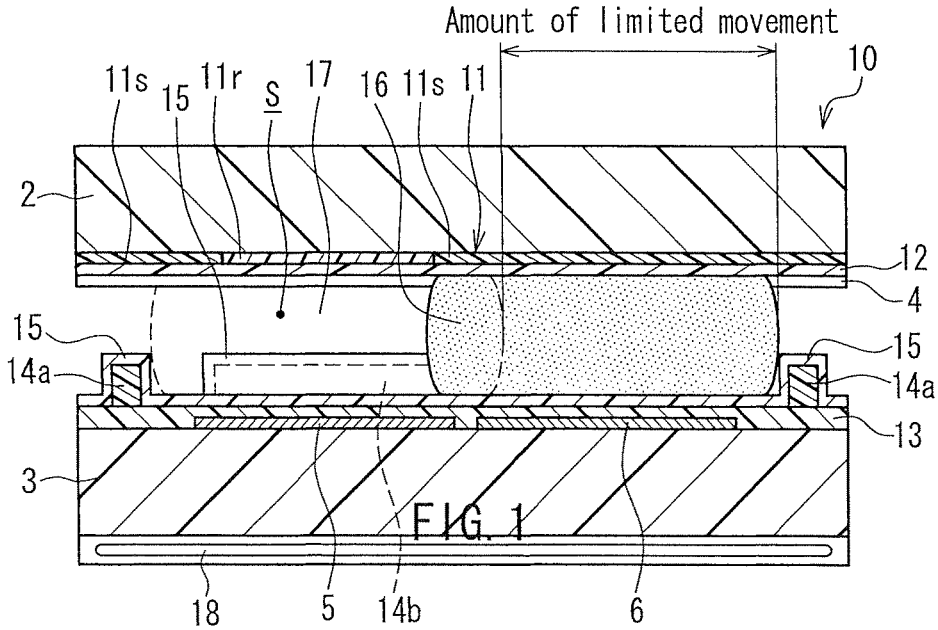
FIG. 1
FIG. 7B

DISPLAY DEVICE AND ELECTRIC APPARATUS USING THE SAME

This application is the U.S. national phase of International Application No. PCT/JP2009/058469, filed 30 Apr. 2009, which designated the U.S. and claims priority to Japanese Patent Application No. 2008-202180, filed 5 Aug. 2008, the entire contents of each of which are hereby incorporated by reference.

TECHNICAL FIELD

The present invention relates to a display device that displays information such as images and characters by moving a conductive liquid, and an electric apparatus using the display device.

BACKGROUND ART

In recent years, as typified by an electrowetting type display device, a display device that displays information by utilizing a transfer phenomenon of a conductive liquid due to an external electric field has been developed and put to practical use.

Specifically, such a conventional display device includes first and second electrodes, first and second substrates, and a colored droplet that is sealed in a display space formed between the first substrate and the second substrate and serves as a conductive liquid that is colored a predetermined color (see, e.g., Patent Document 1). In this conventional display device, a voltage is applied to the colored droplet via the first electrode and the second electrode to change the shape of the colored droplet, thereby changing the display color on a display surface.

For the above conventional display device, another configuration also has been proposed, in which the first electrode and the second electrode are arranged side by side on the first substrate and electrically insulated from the colored droplet, and a third electrode is provided on the second substrate so as to face the first electrode and the second electrode. Moreover, a light-shielding shade is provided above the first electrode. Thus, the first electrode side and the second electrode side are defined as a non-effective display region and an effective display region, respectively. With this configuration, a voltage is applied so that a potential difference occurs between the first electrode and the third electrode or between the second electrode and the third electrode. In this case, compared to the way of changing the shape of the colored droplet, the colored droplet can be moved toward the first electrode or the second electrode at a high speed, and thus the display color on the display surface can be changed at a high speed as well.

PRIOR ART DOCUMENTS

Patent Documents

Patent Document 1; JP 2004-252444 A

DISCLOSURE OF INVENTION

Problem to be Solved by the Invention

In the above conventional display device, the voltage is applied to the corresponding electrode so that the potential difference between the first electrode and the third electrode or the potential difference between the second electrode and the third electrode is any value in the range of 0 V to E V. In this manner, the conventional display device is considered to be able to perform halftone display.

However, the conventional display device cannot accurately perform the halftone display and has difficulty in improving the display quality.

Specifically, when the halftone display is performed by reducing the amount of movement of the colored droplet (conductive liquid), the conventional display device is required to apply the voltage so that the potential difference between the first electrode and the third electrode or the potential difference between the second electrode and the third electrode is extremely small. However, in the conventional display device, if the potential difference is extremely small, there are some cases where the colored droplet is not moved, and the halftone display cannot be accurately performed. Consequently, it is difficult to improve the display quality of the conventional display device.

With the foregoing in mind, it is an object of the present invention to provide a display device that can accurately perform the halftone display and have excellent display quality, and an electric apparatus using the display device.

Means for Solving Problem

To achieve the above object, a display device of the present invention includes the following: a first substrate provided on a display surface side; a second substrate provided on a non-display surface side of the first substrate so that a predetermined display space is formed between the first substrate and the second substrate; an effective display region and a non-effective display region that are defined with respect to the display space; and a conductive liquid sealed in the display space so as to be moved toward the effective display region or the non-effective display region. The display device is capable of changing a display color on the display surface side by moving the conductive liquid. The display device includes the following: a signal electrode that is placed in the display space so as to come into contact with the conductive liquid; a reference electrode that is provided on one of the first substrate and the second substrate so as to be electrically insulated from the conductive liquid and to be located on one of the effective display region side and the non-effective display region side; and a scanning electrode that is provided on one of the first substrate and the second substrate so as to be electrically insulated from the conductive liquid and the reference electrode and to be located on the other of the effective display region side and the non-effective display region side. The signal electrode is configured so that a voltage in a predetermined voltage range between a first voltage and a second voltage can be applied thereto. The reference electrode is configured so that the first voltage or the second voltage can be applied thereto. The scanning electrode is configured so that the first voltage or the second voltage can be applied thereto, and when one of the first voltage and the second voltage is applied to the reference electrode, the other voltage is applied to the scanning electrode. An intermediate voltage between the first voltage and the second voltage and a voltage other than the intermediate voltage are applied to the signal electrode within a predetermined period during which one of the first voltage and the second voltage is applied to the reference electrode.

In the above display device, the intermediate voltage and the voltage other than the intermediate voltage are applied to the signal electrode within the predetermined period. With this configuration, the time that the conductive liquid is not moved, but stands still and the time that the conductive liquid is moved can be determined within the predetermined period.

Thus, unlike the conventional example, the amount of movement of the conductive liquid can be reduced without extremely reducing the potential difference between the signal electrode and the reference electrode or the scanning electrode. Consequently, unlike the conventional example, the display device can accurately perform the halftone display and have excellent display quality.

In the above display device, it is preferable that a plurality of the signal electrodes are provided along a predetermined arrangement direction, and a plurality of the reference electrodes and a plurality of the scanning electrodes are alternately arranged so as to intersect with the plurality of the signal electrodes. It is also preferable that the display device includes the following: a signal voltage application portion that is connected to the plurality of the signal electrodes and applies a signal voltage in the predetermined voltage range to each of the signal electrodes in accordance with information to be displayed on the display surface side; a reference voltage application portion that is connected to the plurality of the reference electrodes and applies one of a selected voltage and a non-selected voltage to each of the reference electrodes, the selected voltage allowing the conductive liquid to move in the display space in accordance with the signal voltage and the non-selected voltage inhibiting a movement of the conductive liquid in the display space; and a scanning voltage application portion that is connected to the plurality of the scanning electrodes and applies one of a selected voltage and a non-selected voltage to each of the scanning electrodes, the selected voltage allowing the conductive liquid to move in the display space in accordance with the signal voltage the non-selected voltage inhibiting a movement of the conductive liquid in the display space.

In this case, a matrix-driven display device with excellent display quality can be provided.

In the above display device, it is preferable that the voltage other than the intermediate voltage is applied to the signal electrode so that an end point of an application time of the voltage other than the intermediate voltage coincides with an end point of the predetermined period.

In this case, the end point of the movement of the conductive liquid can agree with the end point of the predetermined period, and thus the display quality can be further improved.

In the above display device, the voltage other than the intermediate voltage may be the first voltage or the second voltage.

In this case, the halftone display can be performed by using the voltage applied when the halftone display is not performed, and thus the chive control of the display device can be easily simplified.

In the above display device, a plurality of pixel regions may be provided on the display surface side, the plurality of the pixel regions may be located at each of the intersections of the signal electrodes and the scanning electrodes, and the display space in each of the pixel regions may be partitioned by a partition.

In this case, the display color on the display surface side can be changed for each pixel by moving the conductive liquid in each of the pixels on the display surface side.

In the above display device, the plurality of the pixel regions may be provided in accordance with a plurality of colors that enable full-color display to be shown on the display surface side.

In this case, the color image display can be performed by moving the corresponding conductive liquid properly in each of the pixels.

In the above display device, it is preferable that an insulating fluid that is not mixed with the conductive liquid is movably sealed in the display space.

In this case, the speed of movement of the conductive liquid can be easily improved.

In the above display device, it is preferable that a dielectric layer is formed on the surfaces of the reference electrode and the scanning electrode.

In this case, the dielectric layer reliably increases the electric field applied to the conductive liquid, so that the speed of movement of the conductive fluid can be more easily improved.

In the above display device, the non-effective display region may be defined by a light-shielding layer that is provided on one of the first substrate and the second substrate, and the effective display region may be defined by an aperture formed in the light-shielding layer.

In this case, the effective display region and the non-effective display region can be properly and reliably defined with respect to the display space.

An electric apparatus of the present invention includes a display portion that displays information including characters and images. The display portion includes any of the above display devices.

In the electric apparatus having the above configuration, the display portion uses the display device that can accurately perform the halftone display and have excellent display quality. Thus, a high-performance electric apparatus that includes the display portion with excellent display quality can be easily provided.

Effects of the Invention

The present invention can provide a display device that can accurately perform the halftone display and have excellent display quality, and an electric apparatus using the display device.

BRIEF DESCRIPTION OF DRAWINGS

FIGS. 7A and 7B are diagrams for explaining the position of a conductive liquid after having been moved in a halftone display state and a CF color display state of the display device, respectively.

DESCRIPTION OF THE INVENTION

Figure 1:
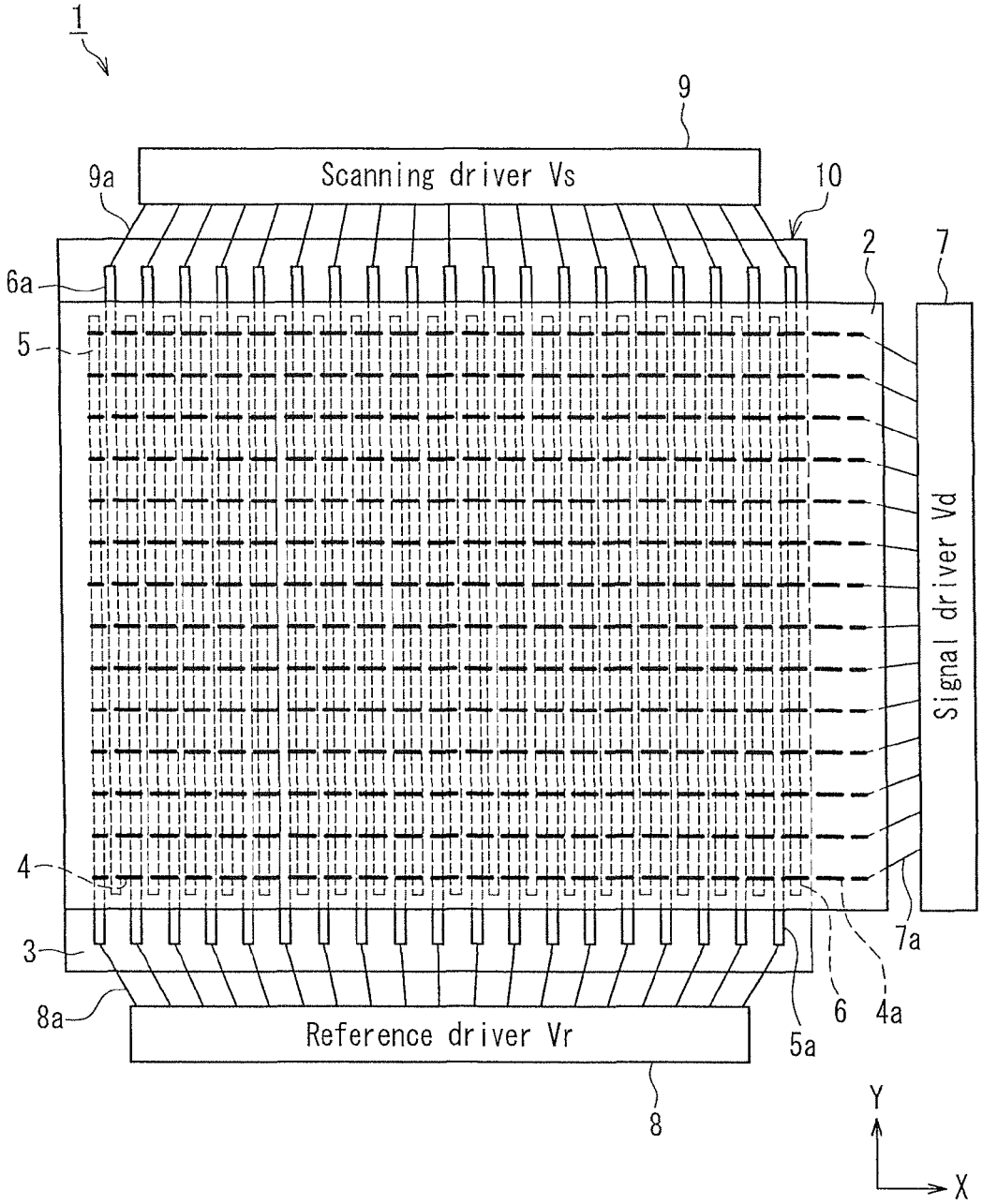
FIG. 1 is plan view for explaining a display device and an image display apparatus of Embodiment 1 of the present invention.

Hereinafter, preferred embodiments of a display device and an electric apparatus of the present invention will be described with reference to the drawings. In the following description, the present invention is applied to an image display apparatus including a display portion that can display color images. The size and size ratio of each of the constituent members in the drawings do not exactly reflect those of the actual constituent members.

[Embodiment 1]

FIG. 1 is a plan view for explaining a display device and an image display apparatus of Embodiment 1 of the present invention. In FIG. 1, an image display apparatus 1 of this embodiment includes a display portion using a display device 10 of the present invention. The display portion has a rectangular display surface. The display device 10 includes an upper substrate 2 and a lower substrate 3 that are arranged to overlap each other in the direction perpendicular to the sheet of FIG. 1. The overlap between the upper substrate 2 and the lower substrate 3 forms an effective display region of the display surface (as will be described in detail later).

In the display device 10, a plurality of signal electrodes 4 are spaced at predetermined intervals and arranged in stripes in the X direction. Moreover, in the display device 10, a plurality of reference electrodes 5 and a plurality of scanning electrodes 6 are alternately arranged in stripes in the Y direction. The signal electrodes 4 intersect with the reference electrodes 5 and the scanning electrodes 6, and a plurality of pixel regions are located at each of the intersections of the signal electrodes 4 and the scanning electrodes 6.

The signal electrodes 4, the reference electrodes 5, and the scanning electrodes 6 are configured so that voltages can be independently applied to these electrodes. In the reference electrodes 5, a High voltage (referred to as "H voltage" in the following) that serves as a first voltage or a Low voltage (referred to as "L voltage" in the following) that serves as a second voltage can be applied, and a voltage in the predetermined voltage range between the H voltage and the L voltage can be applied. Similarly, in the scanning electrodes 6, the H voltage or the L voltage can be applied, and a voltage in the predetermined voltage range between the H voltage and the L voltage can be applied. Moreover, when one of the H voltage and the L voltage is being applied to the reference electrodes 5, the other voltage is applied to the scanning electrodes 6 (as will be described in detail later).

In the signal electrodes 4, a voltage in the predetermined voltage range between the H voltage and the L voltage is applied in accordance with information to be displayed on the display surface. Moreover, for halftone display, an intermediate voltage (a Middle voltage, referred to as "M voltage" in the following) between the H voltage and the L voltage and a voltage other than the M voltage are applied to the signal electrodes 4 within a predetermined period during which one of the H voltage and the L voltage is applied to the reference electrode 5, as will be described in detail later.

In the display device 10, the pixel regions are separated from one another by partitions and provided in accordance with a plurality of colors that enable full-color display to be shown on the display surface, as will be described in detail later. The display device 10 changes the display color on the display surface by moving a conductive liquid (as will be described later) for each of a plurality of pixels (display cells) arranged in a matrix using an electrowetting phenomenon.

One end of the signal electrodes 4, the reference electrodes 5, and the scanning electrodes 6 are extended to the outside of the effective display region of the display surface and form terminals 4*a*, 5*a*, and 6*a*, respectively.

A signal driver 7 is connected to the individual terminals 4*a* of the signal electrodes 4 via wires 7*a*. The signal driver 7 constitutes a signal voltage application portion and applies a signal voltage Vd to each of the signal electrodes 4 in accordance with information when the image display apparatus 1 displays the information including characters and images on the display surface.

A reference driver 8 is connected to the individual terminals 5*a* of the reference electrodes 5 via wires 8*a*. The reference driver 8 constitutes a reference voltage application portion and applies a reference voltage Vr to each of the reference electrodes 5 when the image display apparatus 1 displays the information including characters and images on the display surface.

A scanning driver 9 is connected to the individual terminals 6*a* of the scanning electrodes 6 via wires 9*a*. The scanning driver 9 constitutes a scanning voltage application portion and applies a scanning voltage Vs to each of the scanning electrodes 6 when the image display apparatus 1 displays the information including characters and images on the display surface.

The scanning driver 9 applies either a non-selected voltage or a selected voltage to each of the scanning electrodes 6 as the scanning voltage Vs. The non-selected voltage inhibits the movement of the conductive liquid and the selected voltage allows the conductive liquid to move in accordance with the signal voltage Vd. Moreover, the reference driver 8 is operated with reference to the operation of the scanning driver 9. The reference driver 8 applies either the non-selected voltage that inhibits the movement of the conductive liquid or the selected voltage that allows the conductive liquid to move in accordance with the signal voltage Vd to each of the reference electrodes 5 as the reference voltage Vr.

In the image display apparatus 1, the scanning driver 9 applies the selected voltage to each of the scanning electrodes 6 in sequence, e.g., from the left to the right of FIG. 1, and the reference driver 8 applies the selected voltage to each of the scanning electrodes 6 in sequence from the left to the right of FIG. 1 in synchronization with the operation of the scanning driver 9. Thus, the scanning driver 9 and the reference driver 8 perform their respective scanning operations for each line (as will be described in detail later).

The signal driver 7, the reference driver 8, and the scanning driver 9 include a direct-current power supply or an alternating-current power supply that supplies the signal voltage Vd, the reference voltage Vr, and the scanning voltage Vs, respectively.

The reference driver 8 switches the polarity of the reference voltage Vr at predetermined time intervals (e.g., 1 frame). Moreover, the scanning driver 9 switches the polarity of the scanning voltage Vs in accordance with the switching of the polarity of the reference voltage Vr. Thus, since the polarities of the reference voltage Vr and the scanning voltage Vs are switched at predetermined time intervals, the localization of charges in the reference electrodes 5 and the scanning electrodes 6 can be prevented, compared to the case where the voltages with the same polarity are always applied to the reference electrodes 5 and the scanning electrodes 6. Moreover, it is possible to prevent the adverse effects of a display failure (afterimage phenomenon) and low reliability (a reduction in life) due to the localization of charges.

Moreover, in the single driver 7, the reference driver 8, and the scanning driver 9, the halftone display can be properly adjusted and performed by changing the application time of the M voltage and the application time of the H or L voltage to the signal electrodes 4 within the predetermined period during which one of the H voltage and the L voltage is applied to the reference electrode 5 and the other voltage is applied to the scanning electrode 6, i.e., within a selected period given by the above scanning operations, as will be described in detail later.

The pixel structure of the display device 10 will be described in detail with reference to FIGS. 2 to 4 as well as FIG. 1.

Figure 2:
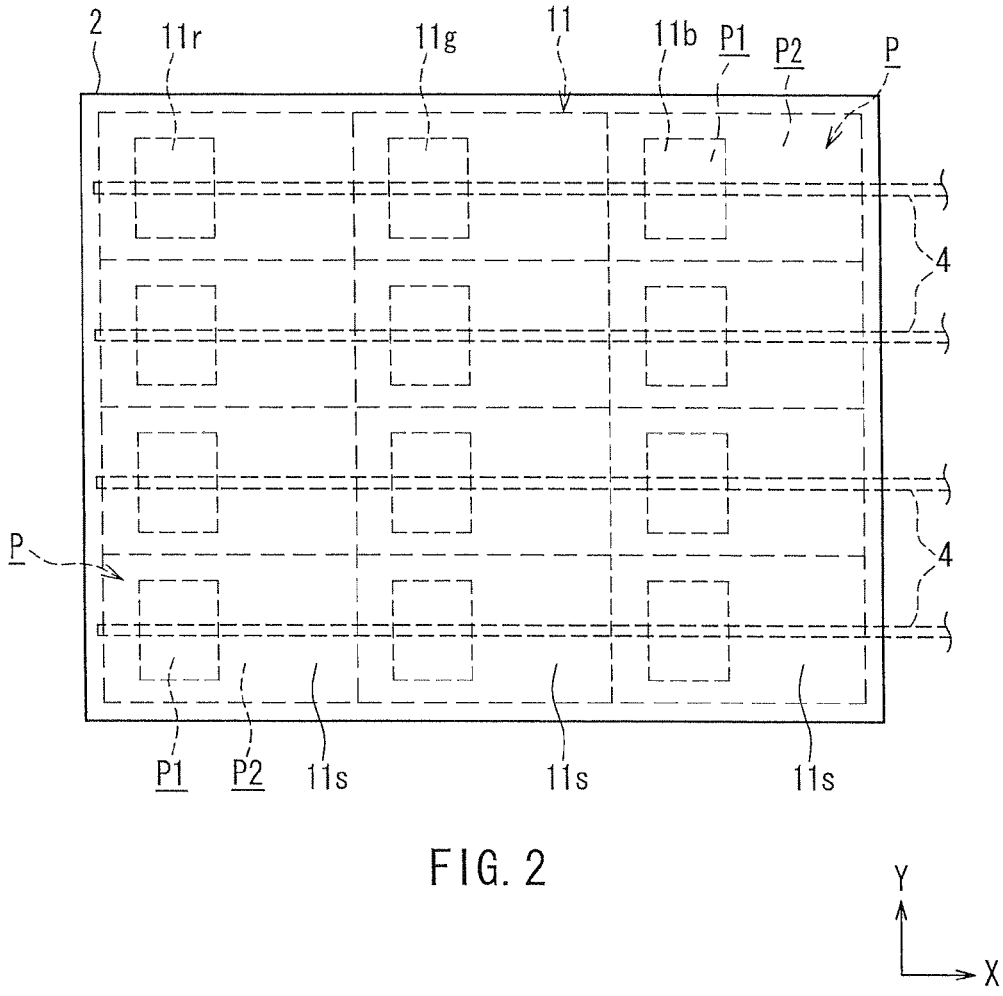
FIG. 2 is an enlarged plan view showing the main configuration of the upper substrate in FIG. 1 when viewed from a display surface side.

FIG. 2 is an enlarged plan view showing the main configuration of the upper substrate in FIG. 1 when viewed from the display surface side. FIG. 3 is an enlarged plan view showing the main configuration of the lower substrate in FIG. 1 when viewed from the non-display surface side. FIGS. 4A and 4B are cross-sectional views showing the main configuration of the display device in FIG. 1 during non-CF color display and CF color display, respectively. For the sake of simplification, FIGS. 2 and 3 show twelve pixels placed at the upper left corner of the plurality of pixels on the display surface in FIG. 1.

Figure 3:
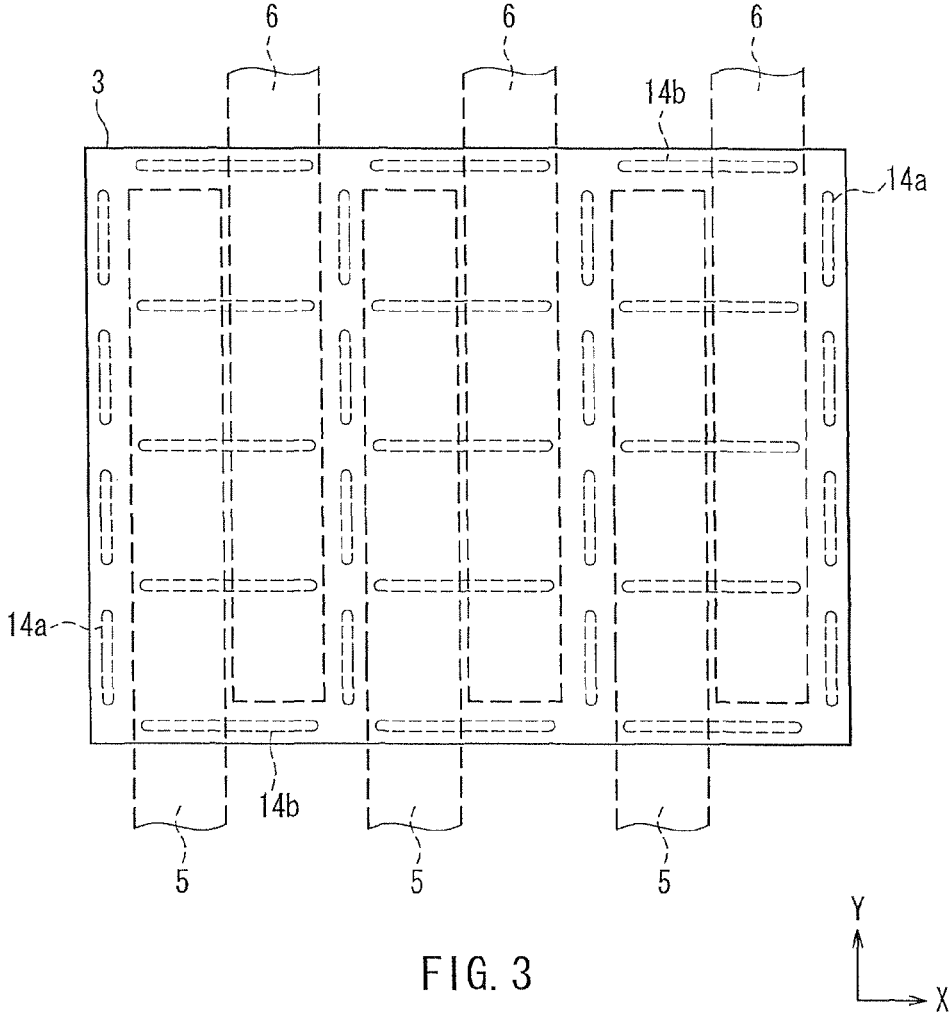
FIG. 3 is an enlarged plan view showing the main configuration of the lower substrate in FIG. 1 when viewed from a non-display surface side.
Figure 4A:
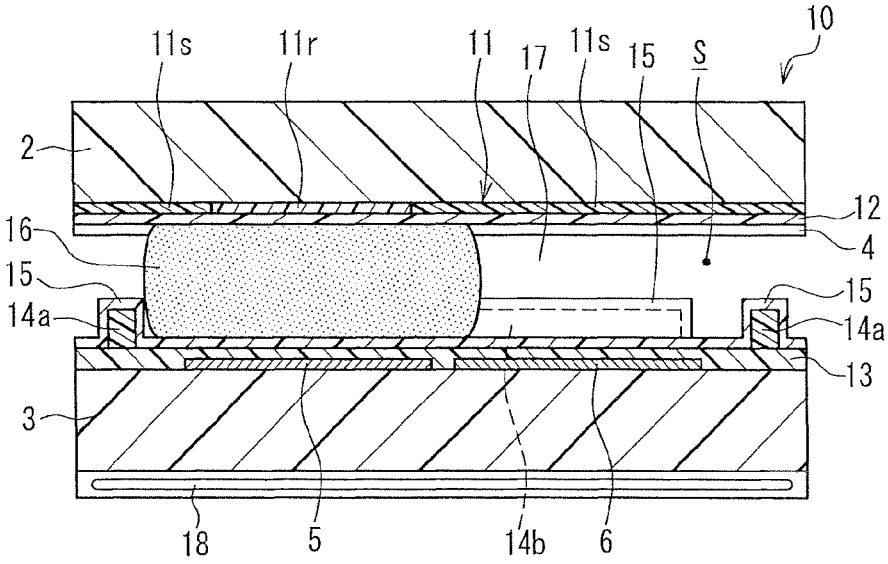
FIGS. 4A and 4B are cross-sectional views showing the main configuration of the display device in FIG. 1 during non-CF color display and CF color display, respectively.
Figure 4B:
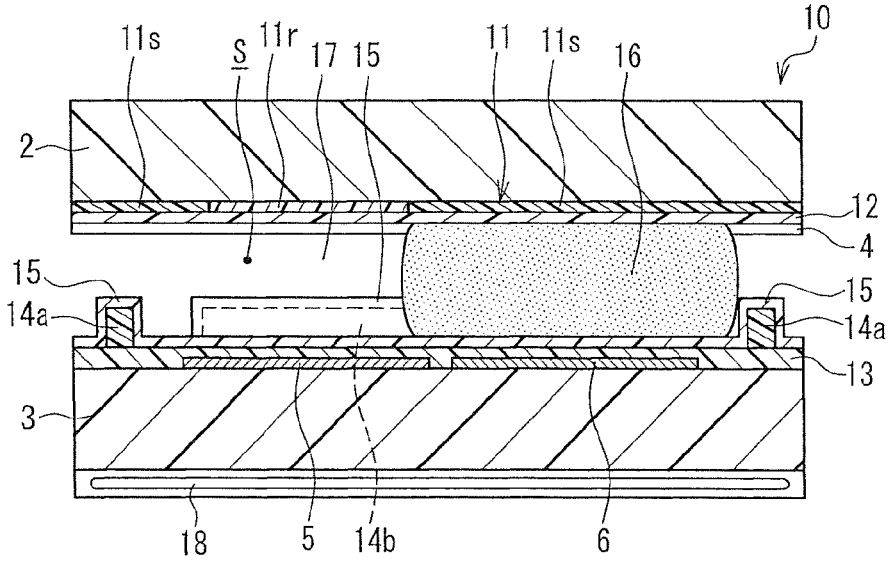

In FIGS. 2 to 4, the display device 10 includes the upper substrate 2 that is provided on the display surface side and serves as a first substrate, and the lower substrate 3 that is provided on the back (i.e., the non-display surface side) of the upper substrate 2 and serves as a second substrate. In the display device 10, the upper substrate 2 and the lower substrate 3 are located at a predetermined distance away from each other, so that a predetermined display space S is formed between the upper substrate 2 and the lower substrate 3. The conductive liquid 16 and an insulating oil 17 that is not mixed with the conductive liquid 16 are sealed in the display space S and can be moved in the X direction (the lateral direction of FIG. 4). The conductive liquid 16 can be moved toward an effective display region P1 or a non-effective display region P2, as will be described later.

The conductive liquid 16 can be, e.g., an aqueous solution including water as a solvent and a predetermined electrolyte as a solute. Specifically, 1 mmol/L of potassium chloride (KCl) aqueous solution may be used as the conductive liquid 16. Moreover, the conductive liquid 16 is colored black, e.g., with a self-dispersible pigment.

The conductive liquid 16 is colored black and therefore functions as a shutter that allows or prevents light transmission. When the conductive liquid 16 is slidably moved in the display space S toward the reference electrode 5 (i.e., the effective display region P1) or the scanning electrode 6 (i.e., the non-effective display region P2), the display color of each pixel of the display device 10 is changed to black or any color of RBG, as will be described in detail later.

The oil 17 can be, e.g., a nonpolar, colorless, and transparent oil including one or more than one selected from a side-chain higher alcohol, a side-chain higher fatty acid, an alkane hydrocarbon, a silicone oil, and a matching oil. The oil 17 is shifted in the display space S as the conductive liquid 16 is slidably moved.

The upper substrate 2 can be, e.g., a transparent glass material such as a non-alkali glass substrate or a transparent sheet material such as a transparent synthetic resin (e.g., an acrylic resin). A color filter layer 11 and a hydrophobic film 12 are formed in this order on the surface of the upper substrate 2 that faces the non-display surface side. Moreover, the signal electrodes 4 are provided on the hydrophobic film 12.

Like the upper substrate 2, the lower substrate 3 can be, e.g., a transparent glass material such as a non-alkali glass substrate or a transparent sheet material such as a transparent synthetic resin (e.g., an acrylic resin). The reference electrodes 5 and the scanning electrodes 6 are provided on the surface of the lower substrate 3 that faces the display surface side. Moreover, a dielectric layer 13 is formed to cover the reference electrodes 5 and the scanning electrodes 6. Ribs 14*a* and 14*b* are formed parallel to the Y direction and the X direction, respectively, on the surface of the dielectric layer 13 that faces the display surface side. In the lower substrate 3, a hydrophobic film 15 is further formed to cover the dielectric layer 13 and the ribs 14*a*, 14*b*.

A backlight 18 that emits, e.g., white illumination light is integrally attached to the back (i.e., the non-display surface side) of the lower substrate 3, thus providing a transmission type display device 10. The backlight 18 uses a light source such as a cold cathode fluorescent tube or a LED.

The color filter layer 11 includes red (R), green (G), and blue (B) color filters 11*r*, 11*g*, and 11*b* and a black matrix 11*s* serving as a light-shielding layer, thereby constituting the pixels of R, G, and B colors. In the color filter layer 11, as shown in FIG. 2, the R, G, and B color filters 11*r*, 11*g*, and 11*b* are successively arranged in columns in the X direction, and each column includes four color filters in the Y direction. Thus, a total of twelve pixels are arranged in three columns (the X direction) and four rows (the Y direction).

As shown in FIG. 2, in each of the pixel regions P of the display device 10, any of the R, G, and B color filters 11*r*, 11*g*, and 11*b* is provided in a portion corresponding to the effective display region P1 and the black matrix 11*s* is provided in a portion corresponding to the non-effective display region P2 of the pixel. In other words, with respect to the display space S, the non-effective display region (non-aperture region) P2 is defined by the black matrix (light-shielding layer) 11*s* and the effective display region P1 is defined by an aperture (i.e., any of the color filters 11*r*, 11*g*, and 11*b*) formed in that black matrix 11*s*.

In the display device 10, the area of each of the color filters 11*r*, 11*g*, and 11*b* is the same as or slightly larger than that of the effective display region P1. On the other hand, the area of the black matrix 11*s* is the same as or slightly smaller than that of the non-effective display region P2. In FIG. 2, the boundary between two black matrixes 11*s* corresponding to the adjacent pixels is indicated by a dotted line to clarify the boundary between the adjacent pixels. Actually, however, no boundary is present between the black matrixes 11*s* of the color filter layer 11.

In the display device 10, the display space S is divided into the pixel regions P by the ribs 14*a*, 14*b* serving as the partitions as described above. Specifically, as shown in FIG. 3, the display space S of each pixel is partitioned by two opposing ribs 14*a* and two opposing ribs 14*b*. Moreover, in the display device 10, the ribs 14*a*, 14*b* prevent the conductive liquid 16 from flowing into the display space S of the adjacent pixel regions P. The ribs 14*a*, 14*b* are made of, e.g., a light-curing resin, and the height of the ribs 14*a*, 14*b* protruding from the dielectric layer 13 is determined so as to prevent the flow of the conductive liquid 16 between the adjacent pixels.

Other than the above description, e.g., frame-shaped ribs may be formed for each pixel on the lower substrate 3 instead of the ribs 14*a*, 14*b*. Moreover, the top of the frame-shaped ribs may be brought into dose contact with the upper substrate 2 so that the adjacent pixel regions P are hermetically separated from one another. When the top of the ribs comes into dose contact with the upper substrate 2, the signal electrodes 4 are provided to penetrate the ribs, and thus can be placed in the display space S.

The hydrophobic films 12, 15 are made of, e.g., a transparent synthetic resin, and preferably a fluoro polymer that functions as a hydrophilic layer for the conductive liquid 16 when a voltage is applied. This can significantly change the wettability (contact angle) between the conductive liquid 16 and each of the surfaces of the upper and lower substrates 2, 3 that face the display space S. Thus, the speed of movement of the conductive liquid 16 can be improved. The dielectric layer 13 can be, e.g., a transparent dielectric film containing parylene, a silicon nitride, a hafnium oxide, a zinc oxide, a titanium dioxide, or an aluminum oxide.

The reference electrodes 5 and the scanning electrodes 6 are made of, e.g., transparent electrode materials such as indium oxides (ITO), tin oxides ($SnO_2$), and zinc oxides (AZO, GZO, or IZO). The reference electrodes 5 and the scanning electrodes 6 are formed in stripes on the lower substrate 3 by a known film forming method such as sputtering.

The signal electrodes 4 can be, e.g., linear wiring that is arranged parallel to the X direction. The signal electrodes 4 are placed on the hydrophobic film 12 so as to extend substantially through the center of each of the pixel regions P in the Y direction, and further to come into direct contact with the conductive liquid 16 by passing through the conductive liquid 16. This can improve the responsibility of the conductive liquid 16 during a display operation.

A transparent hydrophobic film (not shown) made of, e.g., a fluoro polymer is formed on the surfaces of the signal electrodes 4 and allows the conductive liquid 16 to move smoothly. This hydrophobic film does not electrically insulate the signal electrodes 4 from the conductive liquid 16, and therefore not interfere with the improvement in responsibility of the conductive liquid 16.

Other than the above description, the color filter layer 11, the signal electrodes 4, and the hydrophobic film 12 may be formed in this order on the surface of the upper substrate 2 that faces the non-display surface side.

A material that is electrochemically inert to the conductive liquid 16 is used for the signal electrodes 4. Therefore, even if the signal voltage Vd (e.g., 40 V) is applied to the signal electrodes 4, the electrochemical reaction between the signal electrodes 4 and the conductive liquid 16 can be minimized. Thus, it is possible to prevent electrolysis of the signal electrodes 4 and to improve the reliability and life of the display device 10.

Specifically, the signal electrodes 4 are made of, e.g., an electrode material including at least one of gold, silver, copper, platinum, and palladium. The signal electrodes 4 may be formed by fixing thin wires made of the above metal material on the color filter layer 11 or by mounting an ink material such as a conductive paste containing the metal material on the color filter layer 11 with screen printing or the like.

The shape of the signal electrode 4 is determined using the transmittance of the reference electrode 5 located below the effective display region P1 of the pixel. Specifically, based on a transmittance of about 75% to 95% of the reference electrode 5, the shape of the signal electrode 4 is determined so that the occupation area of the signal electrode 4 on the effective display region P1 is 30% or less, preferably 10% or less, and more preferably 5% or less of the area of the effective display region P1.

In each pixel of the display device 10 having the above configuration, as shown in FIG. 4A, when the conductive liquid 16 is held between the color filter 11*r* and the reference electrode 5, light from the backlight 18 is blocked by the conductive liquid 16, so that the black display (non-CF color display) is performed. On the other hand, as shown in FIG. 4B, when the conductive liquid 16 is held between the black matrix 11*s* and the scanning electrode 6, light from the backlight 18 is not blocked by the conductive liquid 16 and passes through the color filter 11*r*, so that the red display (CF color display) is performed.

Hereinafter, a display operation of the image display apparatus 1 of this embodiment having the above configuration will be described in detail with reference to FIGS. 5 to 8 as well as FIGS. 1 to 4.

Figure 5:
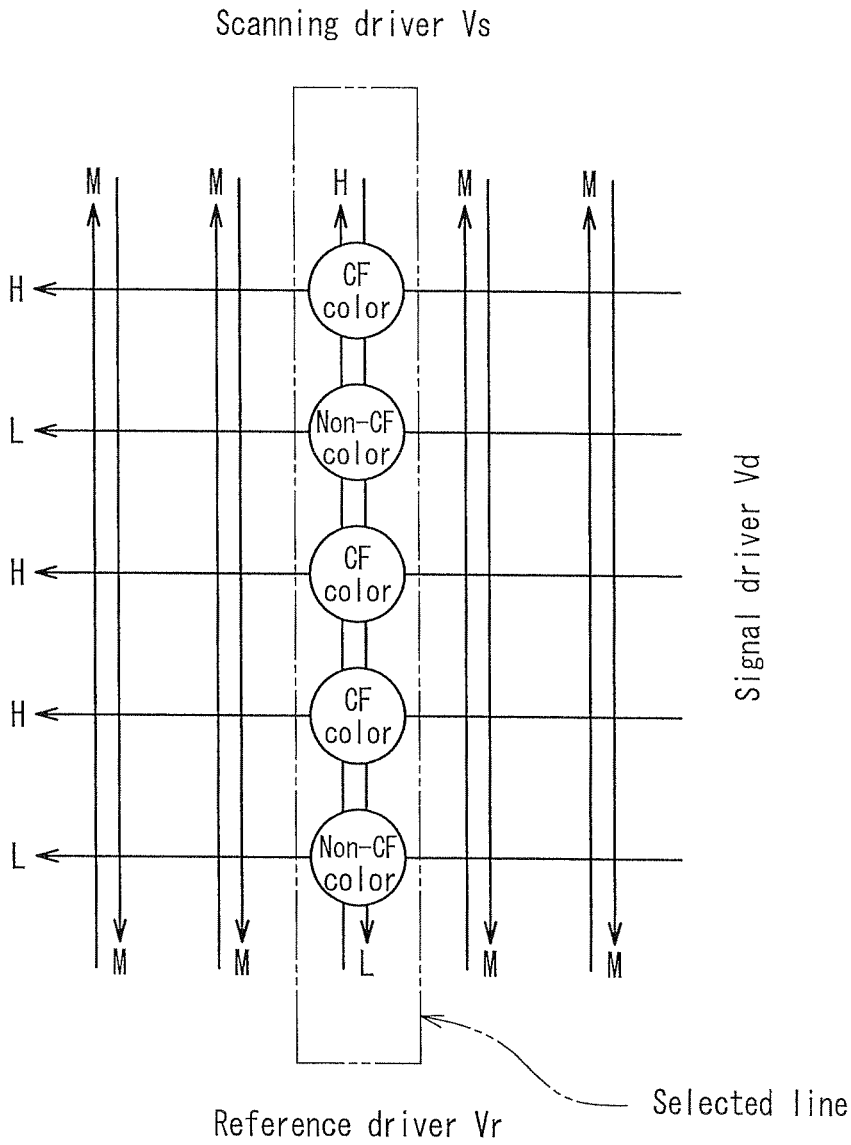
FIG. 5 is a diagram for explaining an operation example of the image display apparatus.

Referring to FIG. 5, first, the basic operation of the image display apparatus 1 will be described.

FIG. 5 is a diagram for explaining an operation example of the image display apparatus 1.

In FIG. 5, the reference driver 8 and the scanning driver 9 apply the selected voltages (i.e., the reference voltage Vr and the scanning voltage Vs) to the reference electrodes 5 and the scanning electrodes 6 in sequence in a predetermined scanning direction, e.g., from the left to the right of FIG. 5, respectively. Specifically, the reference driver 8 and the scanning driver 9 perform their scanning operations to determine a selected line by applying the H voltage (first voltage) and the L voltage (second voltage) as the selected voltages to the reference electrodes 5 and the scanning electrodes 6 in sequence, respectively. In this selected line, the signal driver 7 applies the H or L voltage (i.e., the signal voltage Vd) to the corresponding signal electrodes 4 in accordance with the external image input signal. Thus, in each of the pixels of the selected line, the conductive liquid 16 is moved toward the effective display region P1 or the non-effective display region P2, and the display color on the display surface is changed accordingly.

On the other hand, the reference driver 8 and the scanning driver 9 apply the non-selected voltages (i.e., the reference voltage Vr and the scanning voltage Vs) to non-selected lines, namely to all the remaining reference electrodes 5 and scanning electrodes 6, respectively. Specifically, the reference driver 8 and the scanning driver 9 apply, e.g., the M voltages as the non-selected voltages to all the remaining reference electrodes 5 and scanning electrodes 6, respectively. Thus, in each of the pixels of the non-selected lines, the conductive liquid 16 stands still without unnecessary displacement from the effective display region P1 or the non-effective display region P2, and the display color on the display surface is unchanged.

Table 1 shows the combinations of the voltages applied to the reference electrodes 5, the scanning electrodes 6, and the signal electrodes 4 in the above display operation. As shown in Table 1, the behavior of the conductive liquid 16 and the display color on the display surface depend on the applied voltages. In Table 1, the H voltage, the L voltage, and the M voltage are abbreviated to "H", "L", and "M", respectively (the same is true for Table 2 in the following). The specific values of the H voltage, the L voltage, and the M voltage are, e.g., +7 V, −7 V, and 0 V, respectively.

TABLE 1

| | Reference electrode | Scanning electrode | Signal electrode | Behavior of conductive liquid and display color on display surface |
|---|---|---|---|---|
| Selected line | H | L | H | The conductive liquid is moved toward the scanning electrode. CF color display |
| | | | L | The conductive liquid is moved toward the reference electrode. Black display |
| Non-selected line | M | M | H<br>L | The conductive liquid is still (not moving). Black or CF color display |

<Selected Line Operation>

In the selected line, e.g., when the H voltage is applied to the signal electrodes 4, there is no potential difference between the reference electrode 5 and the signal electrodes 4 because the H voltage is applied to both of these electrodes. On the other hand, a potential difference between the signal electrodes 4 and the scanning electrode 6 occurs because the L voltage is applied to the scanning electrode 6. Therefore, the conductive liquid 16 is moved in the display space S toward the scanning electrode 6 that makes a potential difference from the signal electrodes 4. Consequently, the conductive liquid 16 has been moved toward the non-effective display region P2, as shown in FIG. 4B, and allows the illumination light emitted from the backlight 18 to reach the color filter 11*r* by shifting the oil 17 toward the reference electrode 5. Thus, the display color on the display surface becomes red display (i.e., the CF color display) due to the color filter 11*r*. In the image display apparatus 1, when the CF color display is performed in all the three adjacent R, G, and B pixels as a result of the movement of the conductive liquid 16 toward the non-effective display region P2, the red, green, and blue colors of light from the corresponding R, G, and B pixels are mixed into white light, resulting in the white display.

In the selected line, when the L voltage is applied to the signal electrodes 4, a potential difference occurs between the reference electrode 5 and the signal electrodes 4, but not between the signal electrodes 4 and the scanning electrode 6. Therefore, the conductive liquid 16 is moved in the display space S toward the reference electrode 5 that makes a potential difference from the signal electrodes 4. Consequently, the conductive liquid 16 has been moved toward the effective display region P1, as shown in FIG. 4A, and prevents the illumination light emitted from the backlight 18 from reaching the color filter 11*r*. Thus, the display color on the display surface becomes black display (i.e., the non-CF color display) due to the presence of the conductive liquid 16.

<Non-Selected Line Operation>

In the non-selected lines, e.g., when the H voltage is applied to the signal electrodes 4, the conductive liquid 16 stands still in the same position, and the current display color is maintained. Since the M voltages are applied to both the reference electrodes 5 and the scanning electrodes 6, the potential difference between the reference electrodes 5 and the signal electrodes 4 is the same as that between the scanning electrodes 6 and the signal electrodes 4. Consequently, the display color is maintained without changing from the black display or the CF color display in the current state.

Similarly, in the non-selected lines, even when the L voltage is applied to the signal electrodes 4, the conductive liquid 16 stands still in the same position, and the current display color is maintained. Since the M voltages are applied to both the reference electrodes 5 and the scanning electrodes 6, the potential difference between the reference electrodes 5 and the signal electrodes 4 is the same as that between the scanning electrodes 6 and the signal electrodes 4.

As described above, in the non-selected lines, the conductive liquid 16 is not moved, but stands still and the display color on the display surface is unchanged regardless of whether the H or L voltage is applied to the signal electrodes 4.

On the other hand, in the selected line, the conductive liquid 16 can be moved in accordance with the voltage applied to the signal electrodes 4, as described above, and the display color on the display surface can be changed accordingly.

In the image display apparatus 1, depending on the combinations of the applied voltages in Table 1, the display color of each pixel on the selected line can be, e.g., the CF colors (red, green, or blue) produced by the color filters 11*r*, 11*g*, and 11*b* or the non-CF color (black) due to the conductive liquid 16 in accordance with the voltage applied to the signal electrodes 4 corresponding to the individual pixels, as shown in FIG. 5. When the reference driver 8 and the scanning driver 9 determine a selected line of the reference electrode 5 and the scanning electrode 6 by performing their scanning operations, e.g., from the left to the right of FIG. 5, the display colors of the pixels in the display portion of the image display apparatus 1 also are changed in sequence from the left to the right of FIG. 5. Therefore, if the reference driver 8 and the scanning driver 9 perform the scanning operations at a high speed, the display colors of the pixels in the display portion of the image display apparatus 1 also can be changed at a high speed. Moreover, by applying the signal voltage Vd to the signal electrodes 4 in synchronization with the scanning operation for the selected line, the image display apparatus 1 can display various information including dynamic images based on the external image input signal.

The combinations of the voltages applied to the reference electrodes 5, the scanning electrodes 6, and the signal electrodes 4 are not limited to Table 1, and may be as shown in Table 2.

TABLE 2

| | Reference electrode | Scanning electrode | Signal electrode | Behavior of conductive liquid and display color on display surface |
|---|---|---|---|---|
| Selected line | L | H | L | The conductive liquid is moved toward the scanning electrode. CF color display |
| | | | H | The conductive liquid is moved toward the reference electrode. Black display |
| Non-selected line | M | M | H<br>L | The conductive liquid is still (not moving). Black or CF color display |

The reference driver 8 and the scanning driver 9 perform their scanning operations to determine a selected line by applying the L voltage (second voltage) and the H voltage (first voltage) as the selected voltages to the reference electrodes 5 and the scanning electrodes 6 in sequence in a predetermined scanning direction, e.g., from the left to the right of FIG. 5, respectively. In this selected line, the signal driver 7 applies the H or L voltage (i.e., the signal voltage Vd) to the corresponding signal electrodes 4 in accordance with the external image input signal.

On the other hand, the reference driver 8 and the scanning driver 9 apply the M voltages as the non-selected voltages to the non-selected lines, namely to all the remaining reference electrodes 5 and scanning electrodes 6.

<Selected Line Operation>

In the selected line, e.g., when the L voltage is applied to the signal electrodes 4, there is no potential difference between the reference electrode 5 and the signal electrodes 4 because the L voltage is applied to both of these electrodes. On the other hand, a potential difference between the signal electrodes 4 and the scanning electrode 6 occurs because the H voltage is applied to the scanning electrode 6. Therefore, the conductive liquid 16 is moved in the display space S toward the scanning electrode 6 that makes a potential difference from the signal electrodes 4. Consequently, the conductive liquid 16 has been moved toward the non-effective display region P2, as shown in FIG. 4B, and allows the illumination light emitted from the backlight 18 to reach the color filter 11*r* by shifting the oil 17 toward the reference electrode 5. Thus, the display color on the display surface becomes red display (i.e., the CF color display) due to the color filter 11*r*. Like Table 1, when the CF color display is performed in all the three adjacent R, G, and B pixels, the white display is performed.

In the selected line, when the H voltage is applied to the signal electrodes 4, a potential difference occurs between the reference electrode 5 and the signal electrodes 4, but not between the signal electrodes 4 and the scanning electrode 6. Therefore, the conductive liquid 16 is moved in the display space S toward the reference electrode 5 that makes a potential difference from the signal electrodes 4. Consequently, the conductive liquid 16 has been moved toward the effective display region P1, as shown in FIG. 4A, and prevents the illumination light emitted from the backlight 18 from reaching the color filter 11*r*. Thus, the display color on the display surface becomes black display (i.e., the non-CF color display) due to the presence of the conductive liquid 16.

<Non-Selected Line Operation>

In the non-selected lines, e.g., when the L voltage is applied to the signal electrodes 4, the conductive liquid 16 stands still in the same position, and the current display color is maintained. Since the M voltages are applied to both the reference electrodes 5 and the scanning electrodes 6, the potential difference between the reference electrodes 5 and the signal electrodes 4 is the same as that between the scanning electrodes 6 and the signal electrodes 4. Consequently, the display color is maintained without changing from the black display or the CF color display in the current state.

Similarly, in the non-selected lines, even when the H voltage is applied to the signal electrodes 4, the conductive liquid 16 stands still in the same position, and the current display color is maintained. Since the M voltages are applied to both the reference electrodes 5 and the scanning electrodes 6, the potential difference between the reference electrodes 5 and the signal electrodes 4 is the same as that between the scanning electrodes 6 and the signal electrodes 4.

In the non-selected lines, as shown in Table 2, similarly to Table 1, the conductive liquid 16 is not moved, but stands still and the display color on the display surface is unchanged regardless of whether the H or L voltage is applied to the signal electrodes 4.

On the other hand, in the selected line, the conductive liquid 16 can be moved in accordance with the voltage applied to the signal electrodes 4, as described above, and the display color on the display surface can be changed accordingly.

In the image display apparatus 1 of this embodiment, other than the combinations of the applied voltages shown in Tables 1 and 2, the halftone display can be properly adjusted and performed by changing the application time of the M voltage (i.e., the intermediate voltage) and the application time of the H or L voltage (i.e., a voltage other than the intermediate voltage) to the signal electrodes 4 within the selected period (predetermined period) given by the above scanning operations, as described above.

Hereinafter, the halftone display operation of the image display apparatus 1 of this embodiment will be described in detail with reference to FIGS. 6 to 8. The following description shows an example in which the L voltage is applied as a voltage other than the intermediate voltage.

FIG. 6 is a timing chart showing the magnitude of each voltage applied to the signal electrode, the reference electrode, and the scanning electrode and the application time when the display device performs the halftone display. FIGS. 7A and 7B are diagrams for explaining the position of the conductive liquid after having been moved in a halftone display state and a CF color display state of the display device, respectively. FIG. 8 is a graph showing the relationship between the voltage application time and the amount of movement of the conductive liquid.

Figures 6A, 6B, 6C:
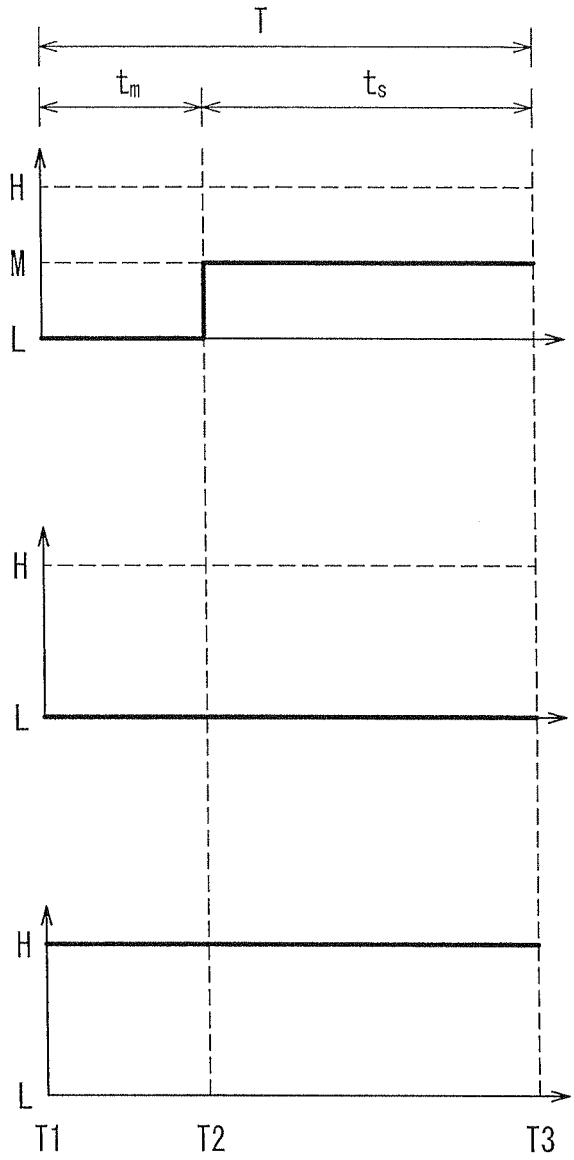
FIG. 6 is a timing chart showing the magnitude of each voltage applied to a signal electrode, a reference electrode, and a scanning electrode and the application time when the display device performs the halftone display.

As shown in FIGS. 6B and 6C, in any of the pixels, the selected period (predetermined period) T is set and the above scanning operations are performed while the L voltage and the H voltage are applied to the reference electrode 5 and the scanning electrode 6, respectively. In this selected period T, when the L voltage (i.e., the signal voltage Vd) is applied to the signal electrodes 4, the conductive liquid 16 is moved in the direction from the reference electrode 5 to the scanning electrode 6, as shown in Table 2. In this embodiment, as shown in FIG. 6A, the signal driver 7 determines an application time tm of the L voltage, which allows the conductive liquid 16 to move, and an application time ts of the M voltage, which allows the conductive liquid 16 not to move, but to stand still, within the selected period T (starting at time T1 and ending at time T3) based on the halftone levels of information to be displayed. In this embodiment, according to the application times tm, ts thus determined, the signal driver 7 applies the L voltage to the signal electrodes 4 between the time T1 and time T2 of the selected period T, so that the conductive liquid 16 is moved in the direction from the reference electrode 5 to the scanning electrode 6. Subsequently, the signal driver 7 applies the M voltage to the signal electrodes 4 between the time T2 and the time T3 of the selected period T, so that the conductive liquid 16 stands still in the position where it has reached at the time T2. Thus, the halftone display is performed in this embodiment.

Specifically, as shown in FIG. 7A, when the conductive liquid 16 is moved to the intermediate position between the reference electrode 5 and the scanning electrode 6, only part of the light from the backlight 18 passes through the color filter 11*r*, and the remaining light is blocked by the conductive liquid 16, resulting in the halftone display state.

Figure 8:
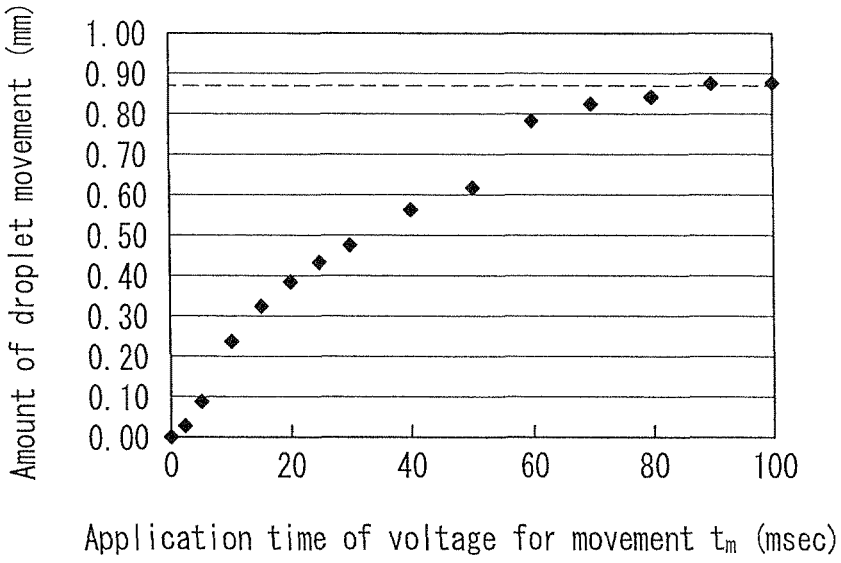
FIG. 8 is a graph showing the relationship between a voltage application time and the amount of movement of the conductive liquid.

As shown in FIGS. 7 and 8, the application time tm and the amount of movement of the conductive liquid 16 can be known in advance, e.g., by experiments using the actual products or simulations. As shown in FIG. 7A, the black display state in which the entire conductive liquid 16 is positioned under the color filter 11*r* is changed to the halftone display state by moving the conductive liquid 16 to the right of FIG.

7A. In this case, the amount of the conductive liquid 16 moving from the black display state to the halftone display state is defined as an amount of droplet movement. As shown in FIG. 7B, the black display state is changed to the CF color display state by moving the entire conductive liquid 16 completely toward the scanning electrode 6. In this case, the amount of the conductive liquid 16 moving from the black display state to the CF color display state is defined as an amount of limited movement. Then, the selected period T is assumed to be, e.g., 100 msec, and the size of each of the reference electrode 5 and the scanning electrode 6 in the lateral direction of FIG. 7 is assumed to be 0.9 mm. Moreover, the H voltage, the L voltage, and the M voltage are set to +7V, −7V, and 0V, respectively. Under these conditions, the data showing the relationship between the application time tm and the amount of droplet movement can be obtained in advance, as plotted in FIG. 8. In this embodiment, the signal driver 7 uses the previously obtained data to properly determine the application times tm, ts, and thus can perform the halftone display with high resolution. Moreover, as can be seen from FIG. 8, the conductive liquid 16 also can be moved in an amount of 10% or less (0.09 mm (=0.9×0.1)), which is unable to be achieved by the conventional example. Thus, many more levels of gray scale can be displayed.

In the display device 10 of this embodiment having the above configuration, when the halftone display is performed, the M voltage (i.e., the intermediate voltage) and the L or H voltage (i.e., a voltage other than the intermediate voltage) are applied to the signal electrodes 4 within the selected period (predetermined period) T. Therefore, the display device 10 of this embodiment can determine the time that the conductive liquid 16 is not moved, but stands still and the time that the conductive liquid 16 is moved within the selected period T. In the display device 10 of this embodiment, unlike the conventional example, the amount of movement of the conductive liquid 16 can be reduced without extremely reducing the potential difference between the signal electrode 4 and the reference electrode 5 or the scanning electrode 6. Consequently, unlike the conventional example, the display device 10 of this embodiment can accurately perform the halftone display and have excellent display quality.

In the image display apparatus (electric apparatus) 1 of this embodiment, the display device 10 is used in the display portion. Therefore, it is possible to easily provide the image display apparatus 1 including a display portion with excellent display quality.

In the display device 10 of this embodiment, the plurality of reference electrodes 5 and the plurality of scanning electrodes 6 are alternately arranged on the lower substrate (second substrate) 3 so as to intersect with the plurality of signal electrodes 4. Moreover, in the display device 10 of this embodiment, the signal driver (signal voltage application portion) 7, the reference driver (reference voltage application portion) 8, and the scanning driver (scanning voltage application portion) 9 apply the signal voltage Vd, the reference voltage Vr, and the scanning voltage Vs to the signal electrodes 4, the reference electrodes 5, and the scanning electrodes 6, respectively. Thus, this embodiment can provide the matrix-driven display device 10 with excellent display quality.

[Embodiment 2]

FIG. 9 is a timing chart showing the magnitude of each voltage applied to the signal electrode, the reference electrode, and the scanning electrode and the application time when a display device of Embodiment 2 of the present invention performs the halftone display. In FIG. 9, this embodiment mainly differs from Embodiment 1 in that a voltage other than the intermediate voltage is applied to the signal electrodes so that the end point of the application time of the voltage other than the intermediate voltage coincides with the endpoint of the predetermined period. The same components as those of Embodiment 1 are denoted by the same reference numerals, and the explanation will not be repeated.

Figures 9A, 9B, 9C:
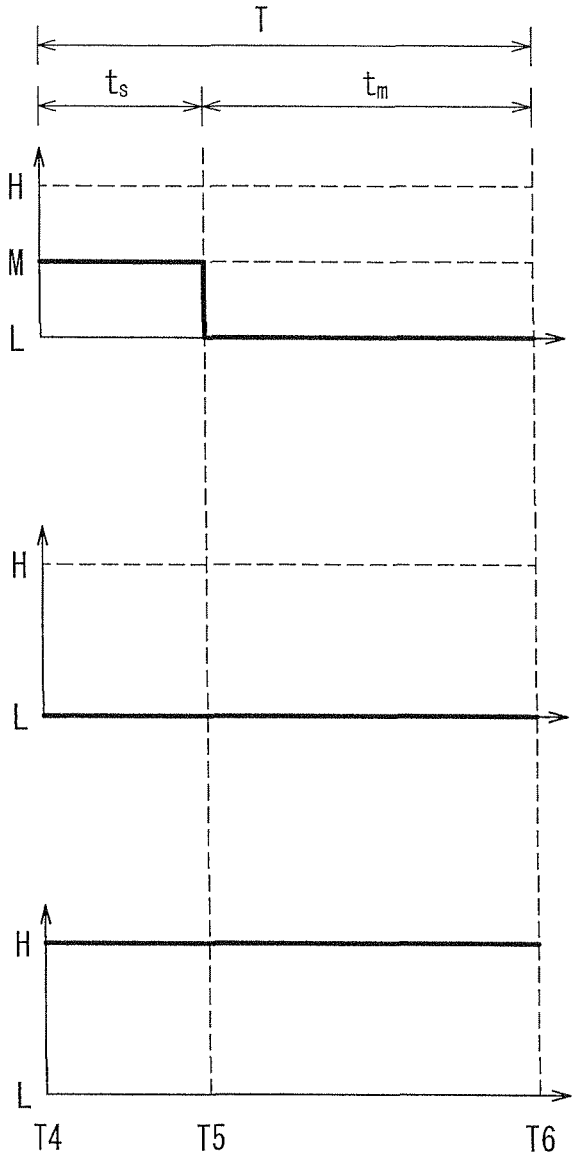
FIG. 9 is a timing chart showing the magnitude of each voltage applied to a signal electrode, a reference electrode, and a scanning electrode and the application time when a display device of Embodiment 2 of the present invention performs the halftone display.

In this embodiment, as shown in FIG. 9, when the selected period T starts at time T4 and ends at time T6, the signal driver 7 determines applications times tm, is so that the end point of the application time tm of the L voltage (i.e., the voltage other than the intermediate voltage) coincides with the time T6 of the selected period T. Specifically, as shown in FIG. 9A, the signal driver 7 applies the M voltage to the signal electrodes 4, which allows the conductive liquid 16 not to move, but to stand still, between the time T4 and time T5 of the selected period T during which the L voltage and the H voltage are applied to the reference electrode 5 and the scanning electrode 6, as shown in FIGS. 9B and 9C, respectively. Subsequently, the signal driver 7 applies the L voltage to the signal electrodes 4, which allows the conductive liquid 16 to move, between the time T5 and the time T6. Thus, the conductive liquid 16 is moved in the direction from the reference electrode 5 to the scanning electrode 6, resulting in the halftone display state.

With the above configuration, this embodiment can have effects comparable to those of Embodiment 1. Moreover, since the L voltage (i.e., the voltage other than the intermediate voltage) is applied to the signal electrodes 4 so that the end point of the application time of the L voltage coincides with the time T6 of the selected period (predetermined period) T, the end point of the movement of the conductive liquid 16 can agree with the end point of the selected period T, and thus the display quality of the display device 10 can be further improved.

[Embodiment 3]

FIG. 10 is a timing chart showing the magnitude of each voltage applied to the signal electrode, the reference electrode, and the scanning electrode and the application time when a display device of Embodiment 3 of the present invention performs the halftone display. In FIG. 10, this embodiment mainly differs from Embodiment 1 in that a plurality of application times of the M voltage to the signal electrodes and a plurality of application times of the L voltage to the signal electrodes are determined within the predetermined period. The same components as those of Embodiment 1 are denoted by the same reference numerals, and the explanation will not be repeated.

Figures 10A, 10B, 10C:
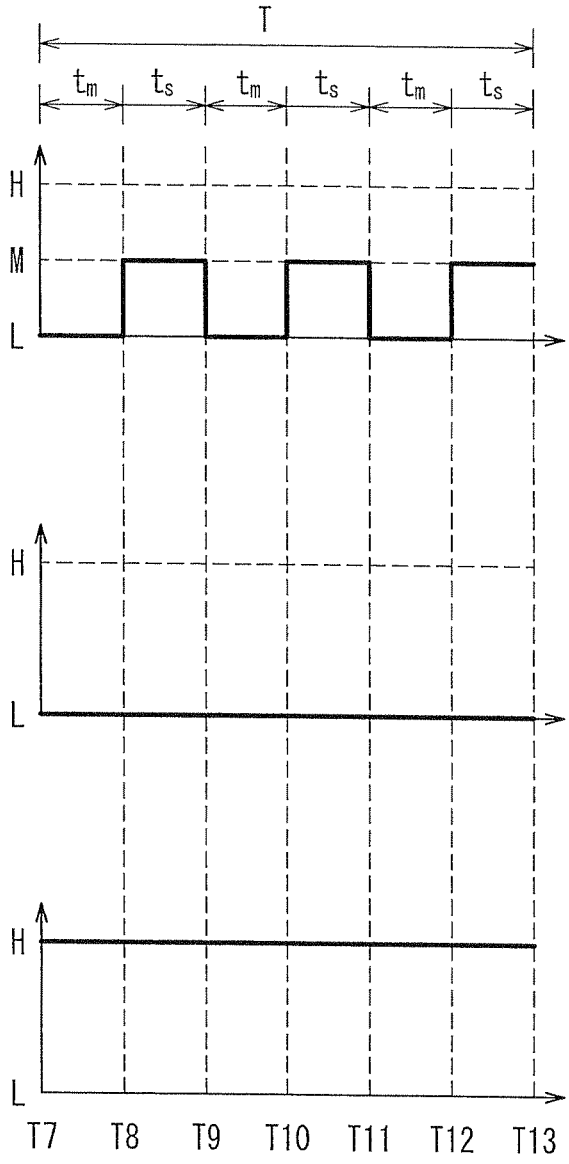
FIG. 10 is a timing chart showing the magnitude of each voltage applied to a signal electrode, a reference electrode, and a scanning electrode and the application time when a display device of Embodiment 3 of the present invention performs the halftone display.

In this embodiment, as shown in FIG. 10, the signal driver 7 determines a plurality of application times ts (e.g., three application times) of the M voltage (i.e., the intermediate voltage) and a plurality of application times tm (e.g., three application times) of the L voltage (i.e., a voltage other than the intermediate voltage) within the predetermined period T starting at time T7 and ending at time T13. Specifically, as shown in FIG. 10A, the signal driver 7 applies the L voltage to the signal electrodes 4, which allows the conductive liquid 16 to move, between the time T7 and time T8. Then, the signal driver 7 applies the M voltage to the signal electrodes 4, which allows the conductive liquid 16 not to move, but to stand still, between the time T8 and time T9. Thereafter, the signal driver 7 applies the L voltage between the time T9 and time 10, the M voltage between the time T10 and time T11, the L voltage between the time T11 and time T12, and the M voltage between the time T12 and the time T13 to the signal electrodes 4. Thus, the conductive liquid 16 is moved in the direction from the reference electrode 5 to the scanning electrode 6, resulting in the halftone display state.

With the above configuration, this embodiment can have effects comparable to those of Embodiment 1.

Other than the above explanation, like Embodiment 2, the L voltage (i.e., the voltage other than the intermediate voltage) may be applied to the signal electrodes 4 so that the end point of the application time of the L voltage coincide with the end point of the predetermined period.

It should be noted that the above embodiments are all illustrative and not restrictive. The technological scope of the present invention is defined by the appended claims, and all changes that come within the range of equivalency of the claims are intended to be embraced therein.

For example, in the above description, the present invention is applied to an image display apparatus including a display portion that can display color images. However, the present invention is not limited thereto, as long as it is applied to an electric apparatus with a display portion that displays the information including characters and images. For example, the present invention is suitable for various electric apparatuses with display portions such as a personal digital assistant such as an electronic organizer, a display apparatus for a personal computer or television, and an electronic paper.

In the above description, the electrowetting-type display device is used, in which the conductive liquid is moved in accordance with the application of an electric field to the conductive liquid. However, the display device of the present invention is not limited thereto, as long as it is an electric-field-induced display device that can change the display color on the display surface by moving the conductive liquid in the display space with the use of an external electric field. For example, the present invention can be applied to other types of electric-field-induced display devices such as an electroosmotic type, an electrophoretic type, and a dielectrophoretic type.

As described in each of the above embodiments, the electrowetting-type display device is preferred because the conductive liquid can be moved at a high speed and a low drive voltage. Moreover, since three different electrodes are used to move the conductive liquid slidably, the electrowetting-type display device can achieve both a high switching speed of the display color on the display surface and electric power saving more easily than the display device in which the shape of the conductive liquid is changed. In the electrowetting-type display device, the display color is changed with the movement of the conductive liquid. Therefore, unlike a liquid crystal display apparatus or the like, there is no viewing angle dependence. Moreover, since a switching device does not need to be provided for each pixel, a high-performance matrix-driven display device having a simple structure can be achieved at a low cost. Further, the electrowetting-type display device does not use a birefringent material such as a liquid crystal layer. Therefore, it is possible to easily provide a high brightness display device with excellent utilization efficiency of light from the backlight or ambient light used for information display.

In the above description, the L voltage (second voltage) or the H voltage (first voltage) is used as a voltage other than the intermediate voltage. However, the voltage other than the intermediate voltage of the present invention is not limited thereto, as long as it is a voltage in the predetermined voltage range between the first voltage and the second voltage other than the intermediate voltage.

As described in each of the above embodiments, the use of the first or second voltage as the voltage other than the intermediate voltage is preferred because the halftone display can be performed by using the voltage applied when the halftone display is not performed, and thus the drive control of the display device can be easily simplified.

The above description refers to the transmission type display device including a backlight. However, the present invention is not limited thereto, and may be applied to a reflection type display device including a light reflection portion such as a diffuse reflection plate, a semi-transmission type display device including the light reflection portion along with a backlight, or the like.

In the above description, the signal electrodes are provided on the upper substrate (first substrate) and the reference electrodes and the scanning electrodes are provided on the lower substrate (second substrate). However, the present invention is not limited thereto, and may have a configuration in which the signal electrodes are placed in the display space so as to come into contact with the conductive liquid, and the reference electrodes and the scanning electrodes are provided on one of the first substrate and the second substrate so as to be electrically insulated from the conductive liquid and each other. Specifically, e.g., the signal electrodes may be provided on the second substrate or on the ribs, and the reference electrodes and the scanning electrodes may be provided on the first substrate.

In the above description, the reference electrodes and the scanning electrodes are located on the effective display region side and the non-effective display region side, respectively. However, the present invention is not limited thereto, and the reference electrodes and the scanning electrodes may be located on the non-effective display region side and the effective display region side, respectively.

In the above description, the reference electrodes and the scanning electrodes are provided on the surface of the lower substrate (second substrate) that faces the display surface side. However, the present invention is not limited thereto, and can use the reference electrodes and the scanning electrodes that are buried in the second substrate made of an insulating material. In this case, the second substrate also can serve as a dielectric layer, which can eliminate the formation of the dielectric layer. Moreover, the signal electrodes may be directly provided on the first and second substrates serving as dielectric layers, and thus may be placed in the display space.

In the above description, the reference electrodes and the scanning electrodes are made of transparent electrode materials. However, the present invention is not limited thereto, as long as either one of the reference electrodes and the scanning electrodes, which are arranged to face the effective display regions of the pixels, are made of the transparent electrode materials. The other electrodes that do not face the effective display regions can be made of opaque electrode materials such as aluminum, silver, chromium, and other metals.

In the above description, the reference electrodes and the scanning electrodes are in the form of stripes. However, the shapes of the reference electrodes and the scanning electrodes of the present invention are not limited thereto. For example, the reflection type display device may use linear or mesh electrodes that are not likely to cause a light loss, since the utilization efficiency of light used for information display is lower in the reflection type display device than in the transmission type display device.

In the above description, the signal electrodes are linear wiring. However, the signal electrodes of the present invention are not limited thereto, and can be wiring with other shapes such as mesh wiring.

As described in each of the above embodiments, it is preferable that the shape of the signal electrodes is determined using the transmittance of the reference electrodes and the scanning electrodes that are transparent electrodes. This is because even if the signal electrodes are made of an opaque material, shadows of the signal electrodes can be prevented from appearing on the display surface, and thus a decrease in display quality can be suppressed. The use of the linear wiring is more preferred because the decrease in display quality can be reliably suppressed.

In the above description, the conductive liquid is a potassium chloride aqueous solution, and the signal electrodes include at least one of gold, silver, copper, platinum, and palladium. However, the present invention is not limited thereto, as long as a material that is electrochemically inert to the conductive liquid is used for the signal electrodes that are placed in the display space and come into contact with the conductive liquid. Specifically, the conductive liquid can be, e.g., a material including an electrolyte such as a zinc chloride, potassium hydroxide, sodium hydroxide, alkali metal hydroxide, zinc oxide, sodium chloride, lithium salt, phosphoric acid, alkali metal carbonate, or ceramics with oxygen ion conductivity. The solvent can be, e.g., an organic solvent such as alcohol, acetone, formamide, or ethylene glycol other than water. The conductive liquid of the present invention also can be an ionic liquid (room temperature molten salt) including pyridine-, alicyclic amine-, or aliphatic amine-based cations and fluorine anions such as fluoride ions or triflate.

As described in each of the above embodiments, the aqueous solution in which a predetermined electrolyte is dissolved is preferred for the conductive liquid because the display device can have excellent handling properties and also be easily produced.

The signal electrodes of the present invention may be in the passive state including an electrode body composed of a conductive metal such as aluminum, nickel, iron, cobalt, chromium, titanium, tantalum, niobium, or an alloy thereof and an oxide film disposed to cover the surface of the electrode body.

As described in each of the above embodiments, the signal electrodes including at least one of gold, silver, copper, platinum, and palladium are preferred because these metals have a low ionization tendency and make it possible not only to simplify the signal electrodes, but also to reliably prevent an electrochemical reaction between the signal electrodes and the conductive liquid. Thus, the display device can easily prevent a reduction in the reliability and have a long life. Moreover, with the use of the metals having a low ionization tendency, the interfacial tension at the interface between the signal electrodes and the conductive liquid can be relatively small. Therefore, when the conductive liquid is not moved, it can be easily held in a stable state at the fixed position.

In the above description, the nonpolar oil is used. However, the present invention is not limited thereto. For example, air may be used instead of the oil, as long as it is an insulating fluid that is not mixed with the conductive liquid. Moreover, silicone oil or an aliphatic hydrocarbon also can be used as the oil.

As described in each of the above embodiments, the nonpolar oil that is not compatible with the conductive liquid is preferred because the droplets of the conductive liquid move more easily in the nonpolar oil compared to the use of air and the conductive liquid. Consequently, the conductive liquid can be moved at a high speed, and the display color can be switched at a high speed.

In the above description, the black colored conductive liquid and the color filter layer are used to form the pixels of R, G, and B colors on the display surface side. However, the present invention is not limited thereto, as long as a plurality of pixel regions are provided in accordance with a plurality of colors that enable full-color display to be shown on the display surface. Specifically, the conductive liquids with different colors such as RGB, CMY composed of cyan (C), magenta (M), and yellow (Y), or RGBYC also can be used.

In the above description, the color filter layer is formed on the surface of the upper substrate (first substrate) that faces the non-display surface side. However, the present invention is not limited thereto, and the color filter layer may be formed on the surface of the first substrate that faces the display surface side or on the lower substrate (second substrate). Thus, the color filter layer is preferred compared to the use of the conductive liquids with different colors because the display device can be easily produced. Moreover, the color filter layer is also preferred because the effective display region and the non-effective display region can be properly and reliably defined with respect to the display space by the color filter (aperture) and the black matrix (light-shielding layer) included in the color filter layer, respectively.

INDUSTRIAL APPLICABILITY

The present invention is useful for a display device that can accurately perform the halftone display and have excellent display quality, and a high-performance electric apparatus using the display device.

| Description of Reference Numerals | |
|---|---|
| 1 | Image display apparatus (electric apparatus) |
| 2 | Upper substrate (first substrate) |
| 3 | Lower substrate (second substrate) |
| 4 | Signal electrode |
| 5 | Reference electrode |
| 6 | Scanning electrode |
| 7 | Signal driver (signal voltage application portion) |
| 8 | Reference driver (reference voltage application portion) |
| 9 | Scanning driver (scanning voltage application portion) |
| 10 | Display device |
| 11 | Color filter layer |
| 11r, 11g, 11b | Color filter (aperture) |
| 11s | Black matrix (light-shielding layer) |
| 13 | Dielectric layer |
| 14a, 14b | Rib (partition) |
| 16 | Conductive liquid |
| 17 | Oil (insulating fluid) |
| S | Display space |
| P | Pixel region |
| P1 | Effective display region |
| P2 | Non-effective display region |

The invention claimed is:

1. A display device that comprises a first substrate provided on a display surface side, a second substrate provided on a non-display surface side of the first substrate so that a predetermined display space is formed between the first substrate and the second substrate, an effective display region and a non-effective display region that are defined with respect to the display space, and a conductive liquid sealed in the display space so as to be moved toward the effective display region or the non-effective display region, and that is capable of changing a display color on the display surface side by moving the conductive liquid, wherein the display device comprises:

a signal electrode that is placed in the display space so as to come into contact with the conductive liquid;

a reference electrode that is provided on one of the first substrate and the second substrate so as to be electrically insulated from the conductive liquid and to be located on one of the effective display region side and the non-effective display region side; and a scanning electrode that is provided on one of the first substrate and the second substrate so as to be electrically insulated from the conductive liquid and the reference electrode and to be located on the other of the effective display region side and the non-effective display region side, and wherein the signal electrode is configured so that a voltage in a predetermined voltage range between a first voltage and a second voltage can be applied thereto, the reference electrode is configured so that the first voltage or the second voltage can be applied thereto, the scanning electrode is configured so that the first voltage or the second voltage can be applied thereto, and when one of the first voltage and the second voltage is applied to the reference electrode, the other voltage is applied to the scanning electrode, and an intermediate voltage between the first voltage and the second voltage and a voltage other than the intermediate voltage are applied to the signal electrode within a predetermined period during which one of the first voltage and the second voltage is applied to the reference electrode.

2. The display device according to claim 1, wherein a plurality of the signal electrodes are provided along a predetermined arrangement direction, and a plurality of the reference electrodes and a plurality of the scanning electrodes are alternately arranged so as to intersect with the plurality of the signal electrodes, and wherein the display device comprises:

a signal voltage application portion that is connected to the plurality of the signal electrodes and applies a signal voltage in the predetermined voltage range to each of the signal electrodes in accordance with information to be displayed on the display surface side;

a reference voltage application portion that is connected to the plurality of the reference electrodes and applies one of a selected voltage and a non-selected voltage to each of the reference electrodes, the selected voltage allowing the conductive liquid to move in the display space in accordance with the signal voltage and the non-selected voltage inhibiting a movement of the conductive liquid in the display space; and a scanning voltage application portion that is connected to the plurality of the scanning electrodes and applies one of a selected voltage and a non-selected voltage to each of the scanning electrodes, the selected voltage allowing the conductive liquid to move in the display space in accordance with the signal voltage and the non-selected voltage inhibiting a movement of the conductive liquid in the display space.

3. The display device according to claim 1, wherein the voltage other than the intermediate voltage is applied to the signal electrode so that an end point of an application time of the voltage other than the intermediate voltage coincides with an end point of the predetermined period.

4. The display device according to claim 1, the voltage other than the intermediate voltage is the first voltage or the second voltage.

5. The display device according to claim 1, wherein a plurality of pixel regions are provided on the display surface side, the plurality of the pixel regions are located at each of the intersections of the signal electrodes and the scanning electrodes, and the display space in each of the pixel regions is partitioned by a partition.

6. The display device according to claim 5, wherein the plurality of the pixel regions are provided in accordance with a plurality of colors that enable full-color display to be shown on the display surface side.

7. The display device according to claim 1, wherein an insulating fluid that is not mixed with the conductive liquid is movably sealed in the display space.

8. The display device according to claim 1, wherein a dielectric layer is formed on the surfaces of the reference electrode and the scanning electrode.

9. The display device according to claim 1, wherein the non-effective display region is defined by a light-shielding layer that is provided on one of the first substrate and the second substrate, and the effective display region is defined by an aperture formed in the light-shielding layer.

10. An electric apparatus comprising a display portion that displays information including characters and images, wherein the display portion comprises the display device according to claim 1.

* * * * *